United States Patent [19]

Antipov et al.

[11] 4,191,264

[45] Mar. 4, 1980

[54] IMPACT WRENCH

[76] Inventors: Georgy A. Antipov, ulitsa Krasny Mayak, 3, kv. 146; Mikhail L. Gelfand, Yaroslavskoe shosse, 129, kv. 44, both of Moscow; Nikolai S. Lavnikov, ulitsa Kustanaiskaya, 117, kv. 10, Rostov-na-Donu; Leonid N. Teres, ulitsa 2 Koltsevaya, 61/21, Rostov-na-Donu; Ivan I. Urazhdin, ulitsa Engelsa, 52/56, kv. 18, Rostov-na-Donu; Yakov I. Tsipenjuk, ulitsa Kirova, 5, kv. 30, Solntsevo Moskovskoi oblasti; Petr S. Yakubovsky, Podshipnikovy pereulok, 12, kv. 36, Rostov-na-Donu, all of U.S.S.R.

[21] Appl. No.: 867,580

[22] Filed: Jan. 6, 1978

[30] Foreign Application Priority Data

Apr. 26, 1977 [SU] U.S.S.R. ..... 2470156

[51] Int. Cl.[2] ..... B25D 15/00

[52] U.S. Cl. ..... 173/93.6; 64/29

[58] Field of Search ..... 64/27 R, 27 CS, 29; 173/12, 93, 93.5, 93.6

[56] References Cited

U.S. PATENT DOCUMENTS

| | | | |
|---|---|---|---|
| 2,146,153 | 2/1939 | Mathewson | 64/27 CS |
| 3,252,300 | 5/1966 | Hofmann | 64/27 CS |
| 3,952,814 | 4/1976 | Gelfand et al. | 173/93 |
| 4,108,252 | 8/1978 | Stroezel | 64/29 X |

FOREIGN PATENT DOCUMENTS

| | | | |
|---|---|---|---|
| 1057834 | 5/1959 | Fed. Rep. of Germany | 64/29 |
| 772674 | 11/1934 | France | 64/27 CS |
| 45386 | 2/1962 | Poland | 64/29 |

*Primary Examiner*—Lawrence J. Staab

*Attorney, Agent, or Firm*—Haseltine, Lake & Waters

[57] ABSTRACT

An impact wrench for tightening threaded joints by imparting a number of rotary blows to the threaded joint. The impact wrench comprises a housing which accommodates an impact clutch comprising an anvil and a hammer which consists of a driving member and a drive member, and a rotary drive of the hammer comprising an electric motor and a reduction gearing which has its output shaft mounted coaxially with the driving member of the hammer and is connected thereto for combined rotation only. The output shaft is connected to the driving member of the hammer by means of a spring-loaded pressure member accommodated in an axial bore of the output shaft and bodies of revolution contained in radial bores of the output shaft and engaging the spring-loaded pressure member. An annular groove is formed in the inner surface of the driving member of the hammer eccentrically relative thereto, and the bodies of revolution are received in the annular groove under the action of the spring-loaded pressure member.

2 Claims, 5 Drawing Figures

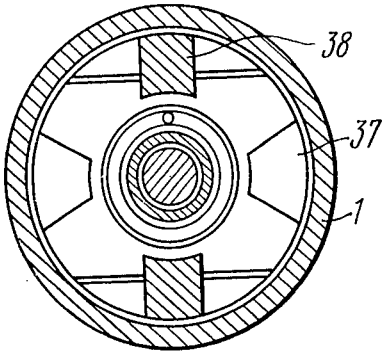
FIG.5
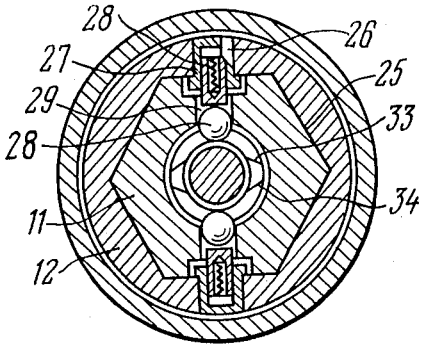
FIG.4
FIG.2
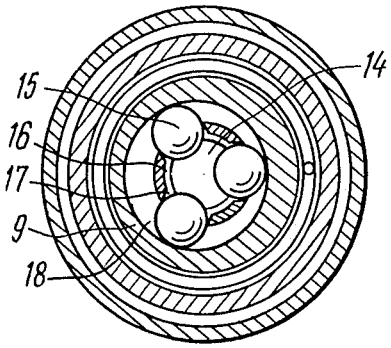
FIG.3
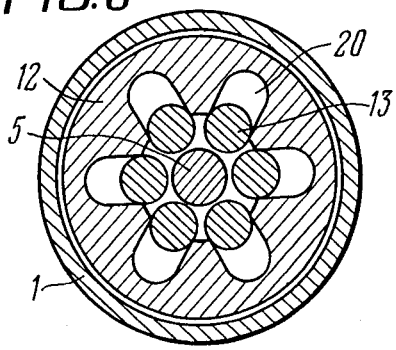

IMPACT WRENCH

FIELD OF THE INVENTION

The invention relates to tools used for tightening threaded joints, and more specifically to impact wrenches for torque tightening by imparting a number of blows to a threaded joint.

PRIOR ART

Known in the art are impact wrenches having a housing accommodating an impact clutch including an anvil and a hammer and a rotary drive of the hammer comprising an electric motor and a reduction gearing having an output shaft. The hammer consists of a driving member and a driven member which are interconnected for combined rotation and axial movement of the driven member relative to the driving member of the hammer for engagement with the anvil. The output shaft of the reduction gearing is mounted coaxially with the driving member of the hammer and is connected thereto for combined rotation only.

In the above-described impact wrenches, the driving member of the hammer is connected to the output shaft of the reduction gearing by means of a friction clutch which protects the electric motor against overload upon impacts (cf. U.S. Pat. No. 3,952,814). The use of the friction clutch for connecting the driving member of the hammer to the output shaft and for protecting the electric motor against overload results, however, in lower stability of the blow rate of the impact wrench due to a substantial scatter of the operating torque of the clutch thus adversely affecting the output of the tool. This disadvantage is especially pronounced when using a high-frequency induction-type motor having a more rigid characteristic than a commutator motor. In addition, the friction clutch imposes an additional load on the motor upon impacts.

The need to accommodate the clutch members in tandem with the driving member of the hammer within the impact wrench results in reduced length of the driving member of the hammer, hence in decreased mass thereof thus reducing the total mass of the parts accumulating the energy during acceleration of the hammer prior to the blow.

The use of ball-type protective clutches in impact wrenches which are able to ensure a stable operating torque is inexpedient due to increased noise (crush sound) as the clutch operates upon every blow. Additionally, the dynamic performance of such clutch results in increased vibrations. It is noted that these clutches are of large axial size (total length of the clutch members, springs and ball diameter).

Known in the art are combined ball and friction clutches. These clutches possess certain advantages over the ball-type clutches, but they are also unsuitable at high blow rate due to high noise. In addition, such clutches are complicated to manufacture.

SUMMARY OF THE INVENTION

The main object of the invention is to improve the efficiency and stability of operation of the impact wrench.

Another object of the invention is to improve reliability of protection of electric motor of the impact wrench against overload upon impact.

With these and other objects in view, in an impact wrench having a housing accommodating an impact clutch including an anvil and a hammer which consists of a driving member and a driven member interconnected for combined rotation and for axial movement of the driven member relative to the driving member of the hammer for engagement with the anvil, and a rotary drive of the hammer comprising an electric motor and a reduction gearing having an output shaft which is mounted coaxially with the driving member of the hammer and connected thereto for combined rotation only, according to the invention, the output shaft of the reduction gearing is formed with a central axial bore accommodating a spring-loaded pressure member and radial bores communicating with the axial bore and containing bodies of revolution, and an annular groove is provided in the inner surface of the driving member of the hammer eccentrically relative thereto and opposite to the radial bores, the bodies of revolution protruding under the action of the spring-loaded pressure member being received in the annular groove, whereby the driving member of the hammer is connected to the output shaft of the reduction gearing.

Due to the above-described manner of connection of the driving member of the hammer to the output shaft, they are reliably interconnected for transmitting torque, whereas the bodies of revolution slip over the eccentric annular groove upon impact. This provides for improved efficiency and stability of operation of the impact wrench due to a low scatter of torque transmitted to the hammer. Motor overload upon impact is substantially reduced, and there is no additional noise. Furthermore, the abovedescribed connection is of a small size in cross-section so that the driving member of the hammer may be made more massive thereby increasing the mass of the components participating in the impact blow. The attachment of the driving member of the hammer to the output shaft of the reduction gearing is made more reliable and simple in construction, because the connection of these parts is now made by means of the same bodies of revolution which participate in the transmission of torque.

BRIEF DESCRIPTION OF THE DRAWINGS

The invention will be now described with reference to a specific embodiment of the impact wrench according to the invention illustrated in the accompanying drawings, in which:

FIG. 2 is a sectional view taken along line II—II in FIG. 1;

FIG. 3 is a sectional view taken along line III—III in FIG. 1;

FIG. 4 is a sectional view taken along line IV—IV in FIG. 1;

FIG. 5 is a sectional view taken along line V—V in FIG. 1.

DETAILED DESCRIPTION

Figure 1:
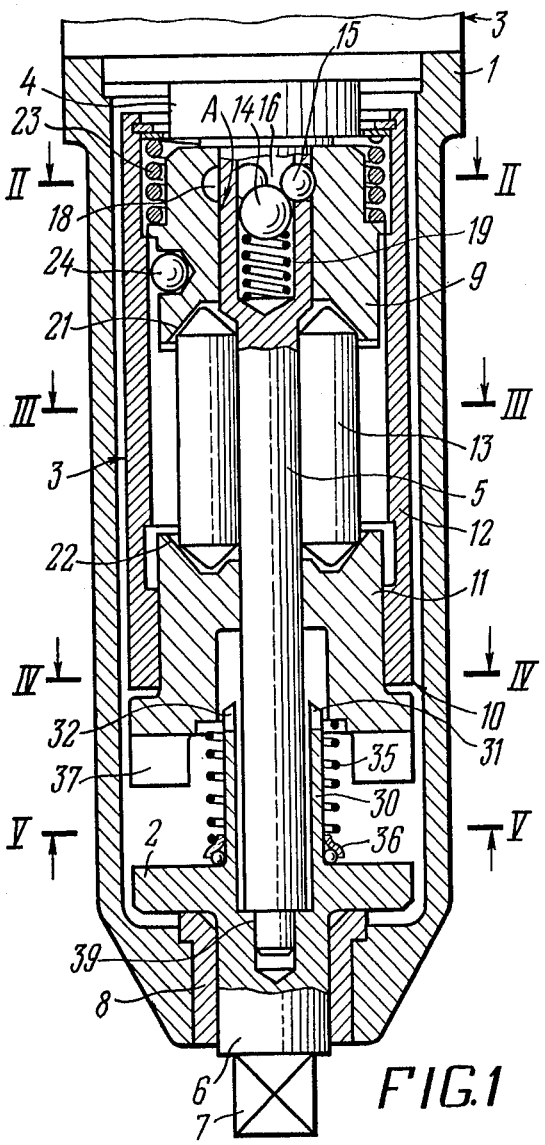
FIG. 1 shows a part of the impact wrench, in longitudinal section, according to the invention.

The impact wrench according to the invention comprises a housing 1 (FIG. 1) accommodating an impact clutch including an anvil 2 and a hammer 3, and a rotary drive of the hammer comprising an electric motor and a reduction gearing 4. The electric motor may be of any type so that it is neither described nor shown in FIG. 1. An output shaft 5 of the reduction gearing 4 extends through the entire housing 1 and is journalled in the anvil 2 as shown in FIG. 1. The anvil 2 is integral with a spindle 6 having a shank 7 for receiving a working tool (socket wrench) and journalled in a bushing 8.

The hammer 3 is axially urged by a spring and includes a driving member 9 and a driven member 10 which consists of an inner element 11 and an outer element 12. Flyweights 13 in the form of rods are arranged between the driving member 9 of the hammer and the inner element 11 thereof.

The output shaft 5 is mounted coaxially with the driving member 9 of the hammer and is connected thereto for combined rotation only. The output shaft 5 extends through the inner element 11 of the driven member 10 of the hammer and is journalled in the anvil 2.

The driving member 9 of the hammer is connected to the output shaft 5 by means of a spring-loaded pressure member 14 comprising, e.g. a ball, and by means of bodies of revolution 15, the output shaft 5 having a central axial bore 16 accommodating the spring-loaded pressure member 14 and radial bores 17 (FIG. 2) communicating with the axial bore 16, the number of the radial bores corresponding to the number of the bodies of revolution 15. Each radial bore 17 contains a body of revolution 15 for engaging the pressure member 14.

An annular groove 18 (FIG. 2) is provided in the inner surface A (FIG. 1) of the driving member 9 of the hammer facing the output shaft 5, the annular groove being made eccentrically relative to the driving member of the hammer and opposite to the radial bores 17. The bodies of revolution 15 partially protruding from the radial bores 17 under the action of the spring-loaded member 14 are received in the annular groove 18, whereby the driving member 9 of the hammer is connected to the output shaft 5 of the reduction gearing, and the bodies of revolution 15 reliably retain the driving member 9 of the hammer from axial displacement along the output shaft 5.

A spring 19 is disposed between the pressure member 14 (FIG. 1) and the bottom of the bore 16 to urge the pressure member 14 against the bodies of revolution 15.

The flyweights 13 are arranged in slots 20 (FIG. 3) in the outer element 12 of the driven member 10 of the hammer to engage, with their respective ends, tapered surfaces 21 and 22 (FIG. 1) of the driving member 9 of the hammer and of the inner element 11 of the hammer.

A spring 23 is provided between the driving member 9 and the outer element 12 of the driven member 10 of the hammer. The driving member 9 of the hammer and the outer element 11 are interconnected, e.g. by means of spherical keys 24 so as to rotate together and to be relatively axially movable for engagement with the anvil 2.

The inner element 11 and the outer element 12 of the driven member 10 of the hammer are coupled at a hexagonal guide surface 25 (FIG. 4) for combined rotation, the inner element 11 being axially movable relative to the outer element 12 of the driven member of the hammer.

The outer element 12 of the driven member has radial bores 26 accommodating locking members 27 urged by springs 28 towards the axis of the impact clutch, the locking members 27 engaging balls 28 received in bores 29 of the inner element 11 of the hammer.

The anvil 2 (FIG. 1) has a hub 30 provided with axial cams 31 having tapers 32, 33 and 34 (FIG. 4). The inner element 11 of the hammer is urged, relative to the anvil 2, by means of a spring 35 (FIG. 1) bearing against a support 36.

Impact jaws 37 are provided at the end face of the inner element 11 of the hammer, and respective impact jaws 38 are made on the anvil 2 (FIG. 5). The impact jaws 37 and the locking members 27, as well as the impact jaws 38 and the axial cams 31 are respectively oriented.

The output shaft 5 is journalled in a bore 39 of the spindle 6.

The impact wrench operates in the following manner.

After the electric motor (not shown) of the impact wrench is energized, the output shaft 5 of the reduction gearing 4 starts rotating together with the bodies of revolution 15. The force of the spring 19 is transmitted, via the pressure member 14, to the bodies of revolution 15 which engage the surface of the annular groove 18 to transmit dynamic torque to the driving member 9 of the hammer. This torque is transmitted, via the balls 24, to the driven member 10 of the hammer. At a predetermined speed of the hammer, the flyweights 13 are displaced from the center to the periphery under the action of centrifugal forces to press, with the end faces thereof, against the tapered surfaces 21, and 22. As a result, the inner element 11 and the outer element 12 of the driven member 10 of the hammer, which are interconnected by means of the locking members 27, are caused to move axially towards the anvil 2 to compress the springs 23 and 35.

Upon the displacement of the driven member 10 of the hammer, the balls 28 approach the axial cams 31. Under the action of the tapers 32, 33 and 34 of the cams 31, the balls 28 are received in the bores 29 to expell the locking members 27. The inner element 11 and the outer element 12 of the hammer are thus disengaged, and the inner element 11 of the hammer continues its movement towards the anvil 2 for engagement of the impact jaws 37 (FIG. 5) with the respective impact jaws 38 of the anvil 2. Upon engagement of the impact jaws 37 and 38 a blow occurs, and the accumulated kinetic energy of the rotating hammer is transmitted to a threaded joint. At the moment of impact, the bodies of revolution 15 slip over the surface of the annular groove 18 to reliably protect the electric motor against overload.

After the hammer stops, the springs 23, 28, 35 cause the parts of the impact clutch to return back to the initial position, and the blows are repeated at regular intervals (until the electric motor is turned off), the impact clutch functioning as described above.

We claim:

1. An impact wrench comprising a housing; an impact clutch accommodated in said housing and comprising an anvil and a hammer which includes a driving member and a driven member interconnected for combined rotation and for axial movement of the driven member relative to the driving member of the hammer for engagement with the anvil; rotary drive means for the hammer accommodated in said housing and comprising a yieldable coupling including a drive shaft having a blind bore; said driving member surrounding said drive shaft and being arranged coaxially therewith; said drive shaft having radial bores; balls arranged substantially within the blind bore and partially protruding therefrom through said radial bores; said driving member having a friction surface facing said radial bores of said drive shaft, said friction surface being constituted as a continuous inner annular groove arranged in a plane substantially at right angles to the longitudinal axis of the drive shaft and eccentrically with respect to said driving member; and a spring-loaded pressure member in said blind bore exerting axial pressure on said balls, whereby said balls engage the bottom and walls of said annular groove.

2. An impact wrench as claimed in claim 1 wherein said annular groove has a cross-section corresponding to a portion of a circle.

* * * * *